United States Patent [19]

Stoddard

[11] Patent Number: 4,669,208

[45] Date of Patent: Jun. 2, 1987

[54] HOLDER FOR ADJUSTABLE INDICATING DEVICES

[75] Inventor: David C. F. Stoddard, Atlanta, Ga.

[73] Assignee: The Mead Corporation, Dayton, Ohio

[21] Appl. No.: 779,483

[22] Filed: Sep. 25, 1985

[51] Int. Cl.[4] ..... G09F 3/20

[52] U.S. Cl. ..... 40/5; 40/10 R; 40/117; 40/518

[58] Field of Search ..... 40/5, 518, 584, 10 R

[56] References Cited

U.S. PATENT DOCUMENTS

| | | | |
|---|---|---|---|
| 2,830,394 | 4/1958 | Gordon et al. | 40/10 R |
| 3,014,294 | 12/1961 | Singer | 40/5 |
| 3,016,638 | 11/1962 | Singer | 40/5 |
| 3,939,584 | 2/1976 | Trame | 40/518 |
| 4,262,436 | 4/1981 | Clement | 40/518 |
| 4,334,372 | 6/1982 | Colmar | 40/5 |

*Primary Examiner*—Robert Peshock
*Assistant Examiner*—Wenceslao J. Contreras
*Attorney, Agent, or Firm*—Rodgers & Rodgers

[57] ABSTRACT

A holder for manually adjustable self-coiling tapes is mounted on shelf moldings in retail outlets by means of a pair of gripping edges projecting from the base of the holder the space between which may be varied by means of an adapter and which are engaged by a pair of spaced gripping ledges forming integral parts of the shelf molding the space between which may vary, the adapter unit having a pair of angularly related strips and being interrelated with a holder gripping edge so as to afford an additional edge to be gripped by one gripping ledge of the shelf molding. According to one embodiment of the invention a removable yieldable insert is provided for mounting on the holder and includes projections on opposite edges thereof for engaging opposite edges of the tapes thereby to position the tapes longitudinally of the holder.

7 Claims, 6 Drawing Figures

HOLDER FOR ADJUSTABLE INDICATING DEVICES

TECHNICAL FIELD

This invention relates to the display of readily changeable price and other data displayed on moldings secured to the edges of display shelves in retail outlets.

BACKGROUND ART

Manually adjustable display devices include self coiling tapes mounted in a suitable holder. An example of such a device is disclosed and claimed in U.S. Pat. No. 4,136,473 issued Jan. 30, 1979 and owned by the assignee of this invention.

DISCLOSURE OF THE INVENTION

According to this invention in one form, scroll like self-coiling tapes which are manually adjustable are disposed within a holder especially adapted for mounting on display shelf moldings having spaced gripping ledges the spacing of which may vary, such ledges being engageable with a pair of spaced gripping edges projecting from the holder base, variations in the space between the gripping ledges of the molding may be accommodated by an elongated adapter unit having a pair of spaced side by side strips which are angularly related to each other one edge of the adapter engaging the gripper device of the holder and another edge thereof being engageable with one of the gripping ledges of the shelf molding. According to another feature of this invention, a removable flexible insert is provided for the holder and includes projections formed on opposite edges thereof which engage the side edges of the self-coiling tapes so as to position the tapes longitudinally of the insert and holder.

BEST MODE OF CARRYING OUT THE INVENTION

Figure 1:
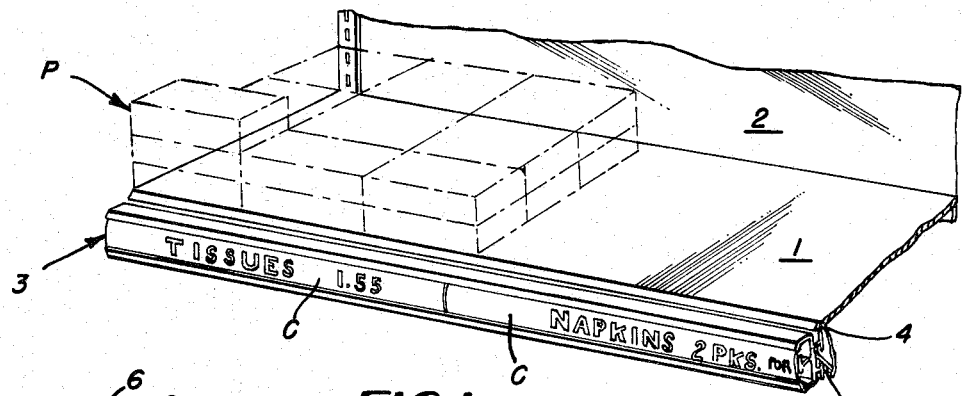
FIG. 1 is a perspective view of a conventional retail market display shelf showing in phantom lines items displayed on the shelf and including conventional shelf molding having oppositely disposed gripping ledges.

In FIG. 1 a conventional retail outlet shelf 1 is shown together with its back 2. A plurality of packages "P" are shown in phantom lines mounted on the shelf 1. Shelf molding generally designated by the numeral 3 is provided with spaced gripping ledges 4 and 5. Conventionally data to be displayed takes the form of paperboard cards C which are inserted between the gripping ledges 4 and 5. Such data is indicated generally in FIG. 1. Changing of such data cards requires manual removal of cards containing superseded data and replacement of such cards with up to date data. Of course such a procedure is expensive and time consuming and requires a considerable amount of inventory of parts such as alphabet letters and numerals.

The special holder formed according to this invention is indicated generally by the numeral 6 while the special adapter formed according to this invention is indicated generally by the numeral 7. The special insert formed according to one aspect of this invention is generally designated by the numeral 8.

The holder 6 includes a base 9 together with walls 10 and 11 which are normally disposed with respect to the base 9 and include inwardly canted edges 12 and 13 which edges are remote from the base 9. Divider means 14 is normal to the base 9 and divides the space between walls 10 and 11 into a pair of cavities 15 and 16 which cavities receive the coiled ends 17 and 18 of self-coiling tape 19 having an observable portion **19*a* disposed in close contacting relationship with the positioning strip 20 secured to the end of divider means 14 which is opposite from the base 9** and whose outer surface is of arcuate configuration.

Figure 2:
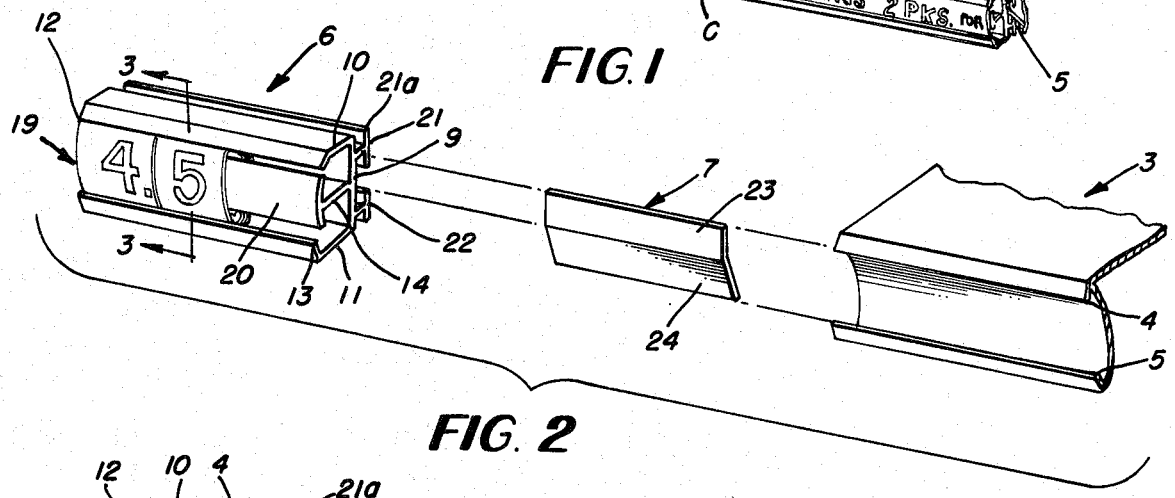
FIG. 2 is an exploded view showing a holder for manually adjustable self-coiling tapes which include changeable indicia as well as adapter means by which the holder may be interrelated with the spaced ledges of the shelf molding.
Figure 3:
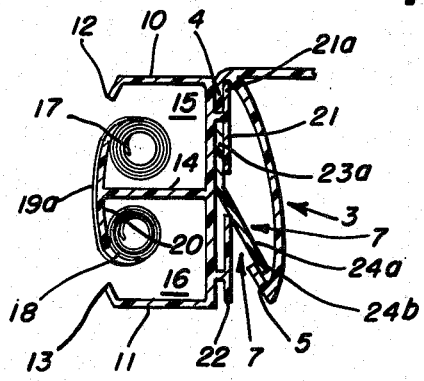
FIG. 3 is a crosssectional view taken along the line designated 3—3 in FIG. 1 and which shows the cooperation of the special adapter with the special tape holder and the gripping ledges of the shelf molding.

According to one feature of this invention, support structures 21 and 22 are provided and are integrally formed with the base 9 of holder 6. These support structures as shown in the drawings are preferably of T-shaped configuration. Where the space between gripping ledges 4 and 5 of the shelf molding 3 is properly related to the width of the T in a vertical direction, the T may simply be inserted between the gripping ledges 4 and 5. Frequently however the space requirements are such that these two dimensional relationships are not adequate for simple mounting of the holder 6. For this reason, an adapter such as is indicated by the numeral 7 is provided according to one aspect of this invention. Adapter 7 includes a pair of side by side elongated strips 23 and 24 which are integral with each other and are angularly disposed with respect to each other as is shown in FIGS. 2 and 3. Depending on particular space conditions, the panels 23 and 24 may be of equal width or if need be one of these panels may be wider than the other panel.

As shown in FIG. 3, the adapter 23 includes a narrow strip **23*a* and a wide strip 24*a*. Thus with the parts arranged as shown in FIG. 3 gripping edge 24*b* cooperates with gripping ledge 5 while gripping edge 21*a* of support structure 21 cooperates with gripping ledge 4. Thus support means for the holder 6 as shown in FIG. 3 includes the gripping edge 21*a* along one edge of the cross bar of the T of support structure 21 and the gripping edge 24*b* of adapter 7. The T-shaped support structure 22 as shown in FIG. 3 simply consitutes an abutment surface which engages the strip 24*a* and thus aids in securing the adapter 7 in proper position along the holder 6**.

For some applications of the invention, it may be desirable to reorient the adapter with respect to support structures 21 and 22 as is obvious. Also the dimensional relationships concerning the widths of panels 23 and 24 may be changed as is necessary to accommodate particular dimensional relationships.

From the description thus far it is obvious that the self-coiling tape such as 19 may be manually adjusted so as to display different indicia such as numerals representing pricing or other information.

Figure 4:
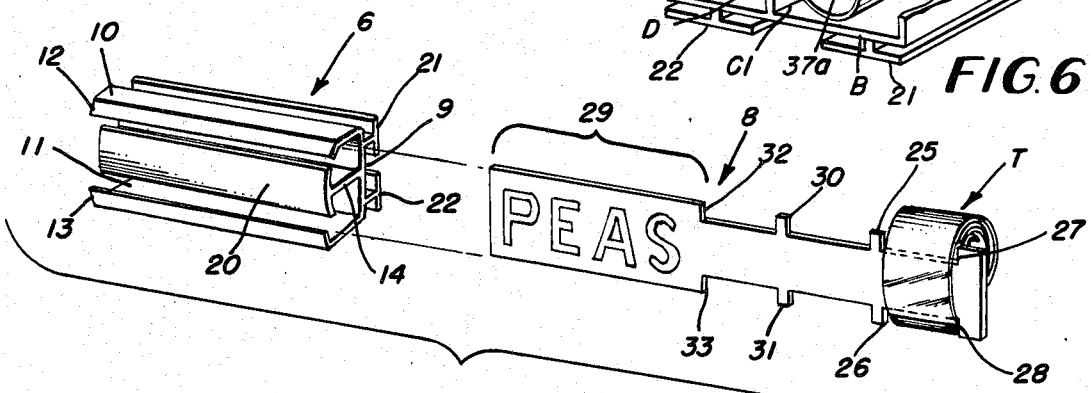
FIG. 4 is an exploded perspective view showing the shelf holder together with a special insert formed according to one aspect of this invention.

For the purpose of positioning a tape such as T longitudinally of the holder 6, positioning tabs such as 25 and 26 may be formed on opposite edges of the insert 8 and such tabs may engage the edge of tape T so as to secure the tape in a desired position longitudinally of the insert 8 and of the holder 6 as shown in FIG. 4. Of course the opposite edge of tape T is engaged by projections 27 and 28.

Insert 8 is both removable and flexible so that it conforms with the curvature of arcuate outer surface of positioning strip 20.

Insert 8 may include areas such as that generally designated by the numeral 29 on which suitable indicia may appear for display purposes and a number of tapes not shown such as T may be mounted on the insert 8 and positioning tabs such as 30 and 31 and 32 and 33 may locate the associated tapes longitudinally so as to display such information as may be appropriate. Obviously such data may be readily changed by simply manually adjusting the position of any one or more of the tapes T.

Figure 5:
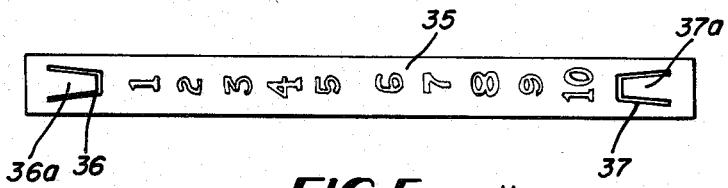
FIG. 5 is a plan view of an uncoiled tape having special stopping means.
Figure 6:
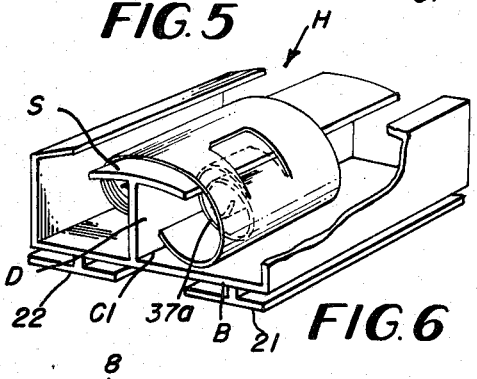
FIG. 6 is a perspective view of the tape of FIG. 5 as mounted in a conventional holder.

On occasions inexperienced users of self-coiling tapes bearing indicia such as price indicia may inadvertently roll a tape completely into a cavity such as 15 or 16. It is almost impossible to extract the tape under such a condition. It is therefore desirable to provide means for preventing inadvertent removal of one end of a tape from its cavity. Toward this end a tape provided according to FIG. 5 may be used. This tape indicated by the numeral 35 is provided with a pair of U-shaped cuts 36 and 37 which define tongue like structures 36*a* and 37*a*. Since these tongue like structures coil about a smaller radius than the remaining portions of the tape when heated and then cooled, a rolled arrangement as shown in FIG. 6 at 37*a* is provided. Thus an attempt to remove the end of the tape from its associated cavity C1 results in abutment of the rolled structure 37*a* with the under surface of the positioning strip S mounted atop divider D formed integrally with the base B of the holder generally designated at H.

INDUSTRIAL APPLICABILITY

This invention is well suited for use in conjunction with data displayed in retail outlets such as pricing, or other information pertaining to goods which are on display. Obviously a major advantage of the invention centers around the fact that such data may easily and efficiently be changed from time to time as conditions may require.

I claim:

1. A holder for displaying scroll-like self-coiling tapes and adapted for mounting on a display shelf molding having spaced gripping ledges, said holder comprising a base, walls secured respectively in normal relation to opposite edges of said base and whose edges remote from said base are canted inwardly toward each other to define a space therebetween, divider means secured to said base and interposed between said walls to define a pair of cavities, and support means including a support structure of T-shaped cross sectional configuration formed integrally with said base and projecting therefrom in a direction which is opposite from said walls, an edge of the cross bar of said support structure of T-shaped cross sectional configuration constituting a gripping edge engageable with one of said gripping ledges, and a separate adapter having one edge engageable with a part of said support structure which is opposite from its gripping edge and having an opposite gripping edge engageable with the other of said gripping ledges.

2. A holder according to claim 1 wherein said support means comprises support structure which is integral with said base and which includes at least one gripping edge which is in engagement with at least one of said ledges.

3. A holder according to claim 1 wherein said separate elongated mounting adapter comprises a pair of integral elongated strips which are angularly disposed with respect to each other in side by side relation.

4. A holder according to claim 3 wherein said strips are of substantially the same width.

5. A holder according to claim 3 wherein said strips are of different widths.

6. A holder according to claim 1 wherein a positioning strip is secured to said divider means remote from said base the opposite edges of which are spaced from the inwardly canted edges of said walls and wherein a self-coiling tape includes an observable portion intermediate its ends and whose ends are coiled and disposed respectively within said cavities and wherein an elongated removable planar insert strip is interposed between the inwardly canted edges of said walls and adjacent said positioning strip and wherein tape positioning tabs are formed on opposite edges of said insert strip for engaging opposite edges of said tape respectively thereby to position said tape longitudinally of said holder.

7. A holder according to claim 6 wherein said insert is held in close face contact with said positioning strip by engagement of its upper and lower edges with said inwardly canted edges of said walls.

* * * * *